United States Patent [19]

Boettcher

[11] Patent Number: 4,565,368

[45] Date of Patent: Jan. 21, 1986

[54] ISOKINETIC EXERCISE AND MONITORING MACHINE

[75] Inventor: Marlon Boettcher, LaCrescent, Minn.

[73] Assignee: Gunderson Clinic, LaCrosse, Wis.

[21] Appl. No.: 522,634

[22] Filed: Aug. 11, 1983

[51] Int. Cl.[4] ..... A63B 21/00; G01L 5/02

[52] U.S. Cl. ..... 272/129; 272/125; 272/116; 272/131; 73/379

[58] Field of Search ..... 272/125, 126, 93, 117, 272/118, 129, 130, 135, 136, DIG. 1, 116, 131; 73/379, 381

[56] References Cited

U.S. PATENT DOCUMENTS

| | | | |
|---|---|---|---|
| 1,992,978 | 3/1935 | Wilson et al. | 403/43 X |
| 3,103,357 | 9/1963 | Berne | 272/79 |
| 3,285,070 | 11/1966 | McDonough | 73/379 |
| 3,465,592 | 9/1969 | Perrine | 73/379 |
| 3,608,541 | 9/1971 | Hall | 128/2 |
| 3,752,144 | 8/1973 | Weigle, Jr. | 128/2 |
| 3,858,873 | 1/1975 | Jones | 272/58 |
| 4,226,415 | 10/1980 | Wright | 272/130 |
| 4,227,689 | 10/1980 | Keiser | 272/130 |
| 4,292,962 | 10/1981 | Krause | 128/68 |
| 4,387,893 | 6/1983 | Baldwin | 272/118 |
| 4,462,252 | 7/1984 | Smidt et al. | 73/379 |
| 4,500,089 | 2/1985 | Jones | 272/118 X |

OTHER PUBLICATIONS

Universal Physical Conditioning Equipment, 1981–1982 Catalog, p. 6; copy in 272–293 Catalog Digest.

"New Machine Pinpoints Source of Backaches," The LaCrosse Tribune, Dec. 2, 1979 (LaCrosse, Wis.).

*Primary Examiner*—Richard J. Apley

*Assistant Examiner*—Alan W. Cannon

*Attorney, Agent, or Firm*—Merchant, Gould, Smith, Edell, Welter & Schmidt

[57] ABSTRACT

An isokinetic exercise and monitoring machine for use in exercising and evaluating an individual's back muscles. A preferred embodiment (10) comprises a restraining means (33) for sandwiching the lower body half that is adjustably connected to a support frame (16); a restraining means (17) for sandwiching the upper body half, including means for pivoting the upper body restraining means (17) about the lower body restraining means (33) in response to the individual's movement generated by extension and flexion of his back muscles; a spring-loaded stop to prevent overtravel and excessive deceleration of the second restraining means (17) at the end of its rotational movement; means for vertically adjusting a platform upon which the individual stands so that the restraining means (17) and (33) engage his body appropriately; and wheels (57) and (58) attached to a support frame (16) to provide portability of the machine (10). The lever arm (13) of a dynamometer (11) attaches to a central point of the upper body restraining means (17) to prevent twisting of the lever arm (13) and problems caused thereby.

52 Claims, 6 Drawing Figures

ISOKINETIC EXERCISE AND MONITORING MACHINE

TECHNICAL FIELD

The invention of the present application relates generally to the field of isokinetic exercise machines. More particularly, this invention relates to an isokinetic exercise and monitoring machine for use in exercising and monitoring the back and trunk muscles of an individual.

BACKGROUND OF THE INVENTION

The invention of the present application involves isokinetic exercise and monitoring machines. Isokinetic exercising is a type of dynamic, as opposed to static, exercise technique. Static exercising is also called isometric and dynamic is often termed isotonic. Isotonic techniques include constant resistance, accommodating resistance and variable resistance, where accommodating resistance is synonymous with isokinetic.

Isokinetic, or accommodating resistance, exercise and monitoring machines supply a matching force for any muscular contraction so that a constant velocity is maintained. That is, whether a prescribed submaximal effort or an absolute maximum contraction is made, the exercising muscles are precisely opposed by the isokentic machine so that a constant velocity is maintained throughout the contraction.

Isokinetic machines are very valuable for a variety of purposes. Such machines have been used in preemployment testing to determine employee compatability with particular work tasks, injury evaluation in the worker's compensation context, rehabilitation exercising, general exercising, and general injury evaluation. Isokinetic machines are particularly useful for evaluating injuries because a submaximal effort is indicated by a lack of reproducibility in the torque or strength output over several repetitions.

Several types of force compensated constant velocity, or isokinetic, machines exist. As discussed in U.S. Pat. No. 3,465,592, issued to J. J. Perrine, there are mechanical, hydraulic and electrical machines that provide an isokinetic characteristic. Electric isokinetic machines, machines that include electromechanical dynamometers, are particularly efficacious because of, among other things, the ease of producing an electrical output that is readily displayed and stored by standard electrical and electronic devices.

One type of electromechanical isokinetic machine is represented by a device manufactured by Cybex Co. of Ronkonkoma, N.Y., a division of Lumex, Inc. The Cybex machine includes an electromechanical dynamometer that has a base including an electrical portion and a lever arm that is pivotally mounted to the base. The muscle or muscle group that is being exercised or evaluated is isolated using straps and supports and a moving portion of a limb, for example, is attached to the lever arm of the dynamometer. As the limb is flexed and extended the amount of muscular force produced will vary depending on several factors, including the angular orientation of the moving portion of the limb, the amount of effort exerted, and the extent of the damage to the limb, and the dynamometer supplies a matching force so that the movement of the limb cannot exceed a threshold velocity. This maximum velocity is predetermined by the physical therapist, for example, and is electrically communicated to the dynamometer base that houses the electromechanical mechanism that is responsible for the accommodating resistance characteristic of the dynamometer. The dynamometer has an electrical output that represents the torque or force developed by the exercising limb. This output may be displayed on a strip chart so that strength, power and work may be further evaluated.

There is a great need for isokinetic machines for exercising and evaluating back muscles. For the purposes of the present application, "back" muscles include all of the trunk and limb muscles that contribute to the extension and flexion of the back. The human back is very susceptible to injury and heretofore it has been very difficult to objectively determine the extent and duration of the injury. Also, pre-employment testing for the back muscles is clearly a useful tool.

An isokinetic machine for exercising and testing back muscles has been developed by the Cybex Co. in conjunction with researchers at the University of Wisconsin-LaCrosse. An individual's lower body is strapped to a support frame while his upper body is restrained by a pivotally movable yoke. The lever arm of a Cybex dynamometer is attached to one corner of the restraining yoke. As the individual flexes and extends his back muscles, the yoke, in contact with the individual's upper body, transmits the muscle-generated forces to the dynamometer lever arm and ultimately to the electromechanical dynamometer mechanism.

Although the LaCrosse type of isokinetic back exercise and monitoring machine is generally useful for its intended purposes, it suffers from several shortcomings. First, the placement of the dynamometer's lever arm with respect to the upper body restraint yoke places an undesirable twisting moment on the dynamometer's lever arm. This twisting moment does not contribute to the measured torque or power generated by the exercising individual and tends to cause binding of the lever arm. In fact, such binding tends to absorb a portion of the torque produced by the back muscles of the individual.

Another problem with the prior art isokinetic back exercising machines, including the LaCrosse machine, is that they do not include a simple vertical adjustment to accommodate persons having various heights. Without such a vertical adjustment the upper body restraining yoke cannot properly and comfortably restrain all exercising individuals.

Still another problem with prior art isokinetic machine is the rapid deceleration suffered by the moving part of the limb, for example, when it reaches the end of its stroke as constrained by the machine.

The LaCrosse isokinetic back machine also lacks a simple horizontal adjustment for the lower body restraint to accommodate persons having various sizes and shapes.

Additionally, the previous devices suffer from a lack of ready portability and inadequate dynamometer base stabilization. When the base of the dynamometer is allowed to move, the entire torque produced by the exercising individual is not indicated by the display and recording devices attached to the dynamometer.

The present invention solves many of the aforementioned problems. In particular, a movable member of a dynamometer is attached to the upper body restraint yoke at a central point, thereby eliminating twisting and binding of the dynamometer's lever arm.

The present invention, in one embodiment, also includes a mechanism for vertical adjustment to accommodate persons of various heights. Similarly, horizontal adjustment of the lower body restraint is provided to accommodate persons of varying girths.

One embodiment of the present invention further includes wheels attached to the support frame, stabilization means for firmly connecting the dynamometer base to the support frame of the machine, and a resilient stop to lessen the rapid deceleration discussed above.

SUMMARY OF THE INVENTION

The present invention is directed to an isokentic exercise and monitoring machine for use in exercising and monitoring the back muscles of an individual. The upper portion of the individual's body, above his waist, is restrained by one restraining means while the individual's lower body, below his waist, is restrained by another restraining means. When the individual flexes and extends his back muscles the restraining means move relative to one another. One member of a dynamometer, corresponding to the base of the dynamometer, is attached to one of the restraining means while a second member of the dynamometer, corresponding to, for example, the lever arm of the dynamometer, is attached to the other restraining means. Connection means are provided to connect the member of the dynamometer corresponding to the lever arm to a central portion of one of the restraining means, thereby minimizing the twisting moment on the dynamometer member.

Vertical adjustment means are also provided by the invention. In a preferred embodiment, a motorized platform is provided so that the individual may be moved vertically to more conveniently position him with respect to the upper and lower body restraining means.

Horizontal adjustment of the lower body restraining means is also provided in a preferred embodiment of the invention.

Means are also provided in one embodiment of the invention for making the isokinetic machine portable. Wheels attached to the supporting frame of the machine permit it to be readily moved.

In a preferred embodiment of the invention, dynamometer stablization means are provided, securely linking the members of the dynamometer to the corresponding body restraining means, and a resilient stopping means is provided to comfortably decelerate the moving portion of the individual's body.

DETAILED DESCRIPTION OF THE INVENTION

Figure 1:
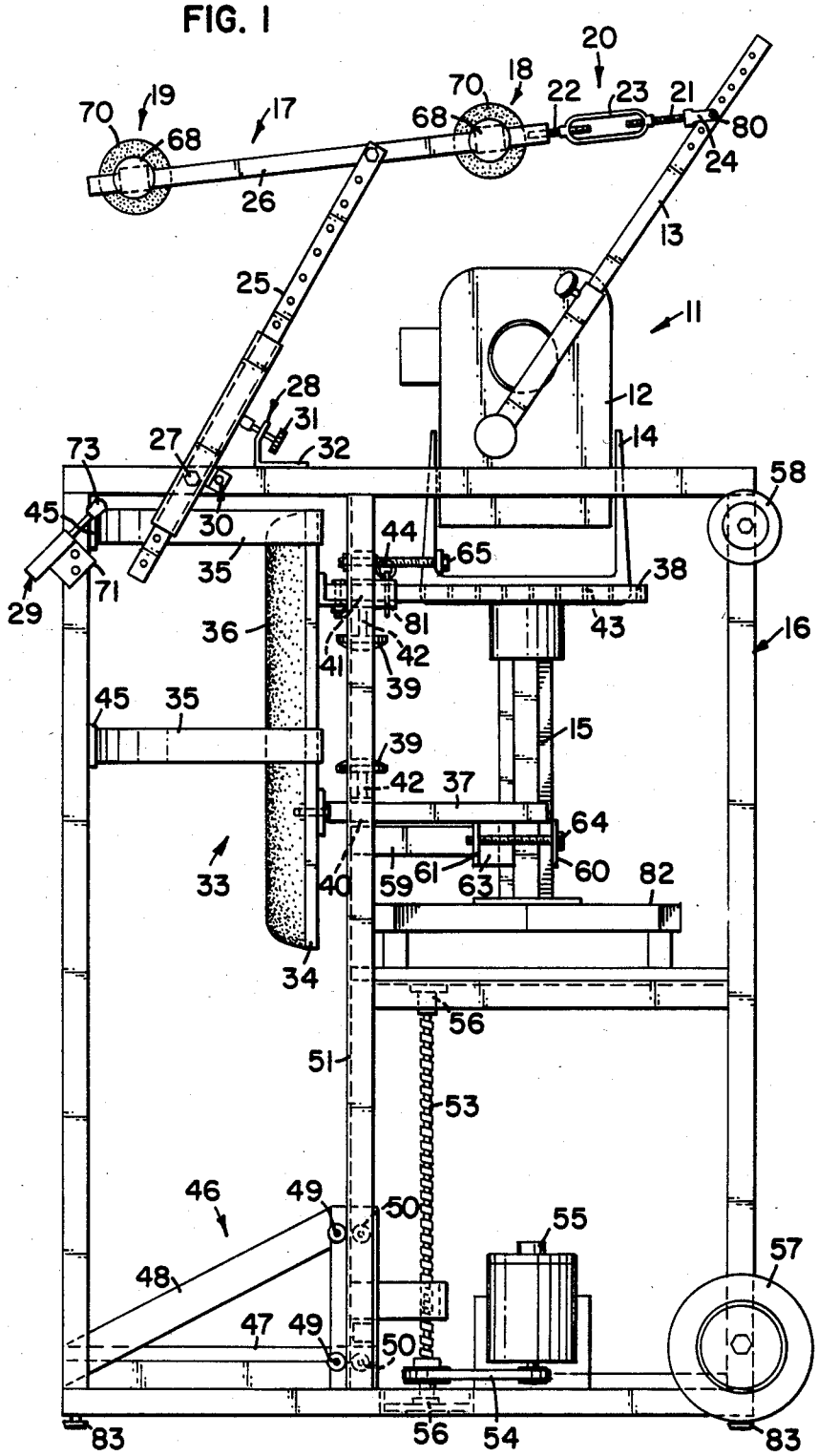
FIG. 1 is a side elevational view of a preferred embodiment of the invention.

Referring now to the drawings wherein like reference numerals denote like elements throughout the several views, FIG. 1 illustrates a side elevational view of a preferred embodiment of the invention, denoted generally by the reference numeral 10. A dynamometer, indicated generally with the reference numeral 11, has a base 12 and a lever arm 13. The Cybex Co. produces a dynamometer that will adequately function in the embodiment of the invention shown in FIG. 1. It should be noted, however, that other types of dynamometers may be used in the isokinetic machine 10 and are contemplated by the invention. For example, mechanical or hydraulic isokinetic dynamometers may be used. The electromechanical type of dynamometer is preferred because of the ease of instrumenting it to set a predetermined speed and of determining the torque output as discussed below. One aspect of the invention is particularly directed to the type of dynamometer shown in FIG. 1. Twisting of the lever arm 13 can be minimized by attaching the lever arm 13 to a particular point of the upper body restraint means as also discussed below.

The dynamometer base 12 is further supported by a dynamometer support yoke 14 attached to a dynamometer pedestal 15.

The machine 10 includes a support frame 16 to which the dynamometer base 12 is fixedly attached as discussed below. It should be noted that the dynamometer base 12 could also simply be attached to the floor or other substantially immovable object.

The dynamometer lever arm 13 is connected to an upper body restraint assembly, indicated generally with the reference numeral 17. The upper body restraint assembly 17 includes a rear crosspiece assembly 18 and a front crosspiece assembly 19, with the crosspiece assemblies 18 and 19 preferably covered with a resilient material as discussed below. The front crosspiece assembly 19 is adapted to engage the front surface of an individual's upper body while the rear crosspiece assembly 18 is adapted to engage the back surface. A turnbuckle assembly 20 is pivotally interposed between the dynamometer lever arm 13 and the rear crosspiece assembly 18. The turnbuckle assembly 20 includes a rear link rod 21 and a front link rod 22. The link rods 21 and 22 preferably include male threads substantially along their entire lengths. The male threads on the link rods 21 and 22 have opposite senses; if the thread on link rod 21 is right handed, then the thread on link rod 22 is left handed and vise versa. The turnbuckle 23 includes female threaded openings suitable for engaging the threaded link rods 21 and 22. When the turnbuckle 23 is axially rotated in a first direction the link rods 21 and 22 approach one another and when the turnbuckle 23 is axially rotated in a second direction the link rods 21 and 22 move away from one another. This permits the free end of the dynamometer lever arm 13 to be moved with respect to the rear crosspiece assembly 18 during set-up of the machine 10 to better accommodate an exercising individual. The rear link rod 21 is pivotally attached to the dynamometer lever arm 13 by a link rod pivot member 24 that operatively engages the rear link rod 21 and the dynamometer lever arm 13. The link rod pivot member 24 preferably includes a female threaded hole at one end suitable for threaded engagement with the rear link rod 21. The link rod pivot member 24 is substantially U-shaped at the other end so that it can straddle the lever arm 13, and the pivot member 24 preferably includes holes that can be aligned with holes on the dynamometer lever arm 13, and a pivot bolt 80 is placed therethrough to provide another means for adjusting the machine 10.

The upper body restraint assembly 17 is preferably pivotally connected to the support frame 16 by a swing arm 25 that is fixedly connected, preferably welded, to an interconnection link 26 that provides a connection between the crosspiece assemblies 18 and 19 and holds them in parallel relationship therebetween. A pivotable connection is provided between the support frame 16 and the swing arm 25 by a pivot bolt 27 through the swing arm 25 and support frame 16. The pivot bolt 27 may be removed so that another hole in the swing arm 25 may be aligned with the corresponding hole in the frame 16 so that the swing arm can be effectively lengthened or shortened.

The machine 10 further includes three means for limiting the travel of the upper body restraint assembly 17 and swing arm 25 as the individual flexes and extends his back muscles. A pair of forward stops 29 limit movement in one direction while rearward upper stops 28 and rearward lower stops 30 limit movement in the opposite direction. The rearward upper stops 28 each comprise a male threaded bumper 31 and a female threaded bumper bracket 32, thereby allowing adjustment of the rearward travel of the upper body restraint assembly 17 by advancing or retracting the threaded bumper 31. The forward stop 29 will be more fully discussed with reference to FIG. 4, below.

The lower body of the exercising individual is restrained by a lower body restraint assembly indicated generally at 33. The lower body restraint assembly 33 preferably includes a wooden back board 34 and nylon straps 35. Further, the back board 34 is covered on its front side with a back board cushion 36 against which the back surface of the individual's lower body makes contact while the individual is utilizing the isokinetic exercising and monitoring machine.

The lower body restraint assembly 33 also includes means for horizontal adjustment. On the rear substantially planar surface of the back board 34 are attached a lower back board adjustment member 37 and a pair of upper back board adjustment members 38. The adjustment members 37 and 38 are substantially perpendicular to the back board 34 and are adapted to slidably engage lower adjustment bracket 40 and upper adjustment bracket 41, respectively. The adjustment brackets 40 and 41 are fixedly attached, preferably welded, to the support frame 16. The adjustment brackets have openings that admit the adjustment members 37 and 38 and allow the adjustment members 37 and 38 to freely slide therein. Hand knobs 39 attached to threaded rods 42 are in threaded engagement with the adjustment brackets 40 and 41, and when the hand knobs 39 are rotated in a clockwise direction the threaded rods 42 engage the adjustment members 37 and 38 so that the lower body restraint assembly is held in a fixed position with respect to the support frame 16. The upper adjustment members 38 and upper adjustment brackets 41 include cotter pin holes 43 and 81, respectively, that accommodate cotter pins 44 so that an even more secure attachment is provided between the lower body restraint assembly 33 and the support frame 16. Strap latches 45 permit the straps 35 to be opened so that an individual can step into the lower body restraint assembly 33 in a more convenient fashion.

The embodiment of the invention 10 also includes a means for vertically moving the individual with respect to the lower body restraint assembly 33 and the upper body restraint assembly 17. A platform assembly 46 is provided for this purpose.

The platform assembly 46 comprises a platform 47, preferably made of plywood, supported by a metal platform frame 48. Attached to the platform frame 48 are outside rollers 49 and inside rollers 50. The rollers 49 and 50 are preferably made of a hard metal, for example steel, and are pinned to the platform frame in any convenient fashion to permit rolling of the rollers 49 and 50. The rollers 49 and 50 are configured to pinch a roller guide 51 which is comprised of angle iron that is fixedly attached to and an integral part of the support frame 16. Operatively attached to the platform frame 48 is a driven block 52 that also engages a vertical worm gear 53. The driven block 52 includes female threads that engage the male threads on the worm gear 53 so that when the worm gear 53 is rotated about its longitudinal axis the driven block 52 is caused to move vertically thereby also moving the platform frame 48 and the platform 47 in a vertical direction. The worm gear 53 is preferably attached to a belt 54 to an electric motor 55 so that it may be so rotated. A 3-position switch (not shown), having an off position, a clockwise position, and a counterclockwise position is preferably included with the preferred embodiment 10 so that the electric motor 55 may be properly energized to turn clockwise or counterclockwise or turned off depending on the vertical adjustment required. Thrust bearings 56 are attached to the support frame 16 and engage the worm gear 53 to allow it to rotate freely about its longitudinal axis when the electric motor 55 is energized.

In order to provide portability to a preferred embodiment of the invention 10, there are rotatably connected to the support frame 16 a pair of lower wheels 57 and a air of upper wheels 58. The machine 10 can then be oriented so that the lower and upper wheels 57 and 58 make contact with the floor and the machine 10 can then be easily rolled from one room to another, for example. The upper body restraint assembly 17 and its attendant hardware are preferably removed or locked to the support frame 16 during this operation.

The wheels 57 and 58 are not in contact with the floor during operation of the machine 10. Attached to the frame 16 are leveling legs 83 that actually support the frame 16 during use of the machine 10. The leveling legs 83 are preferably in threaded engagement with the frame 16 so that they can be retracted and extended as needed to level the machine 10.

Figure 2:
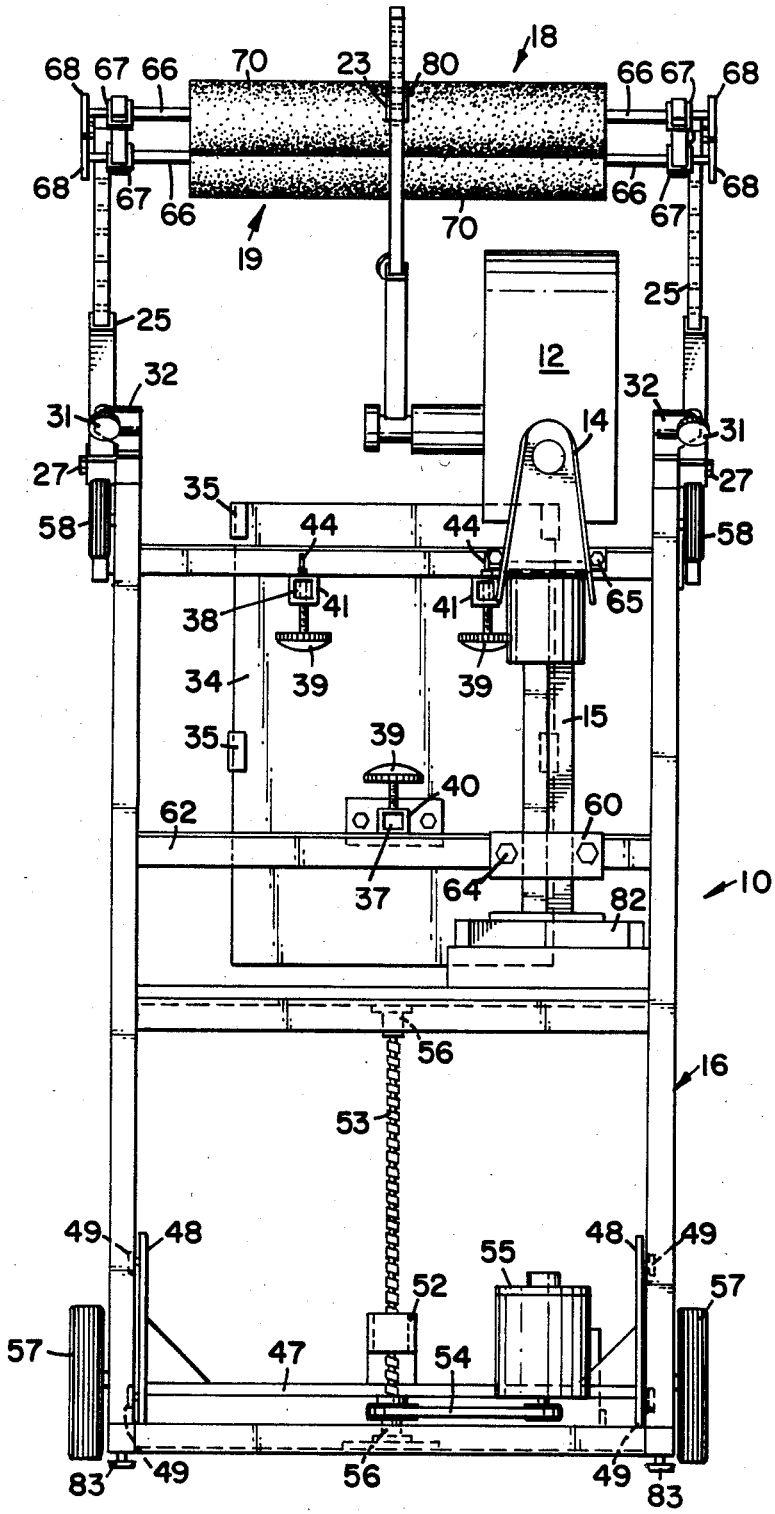
FIG. 2 is a rear elevational view of the embodiment of the invention shown in FIG. 1.
Figure 3:
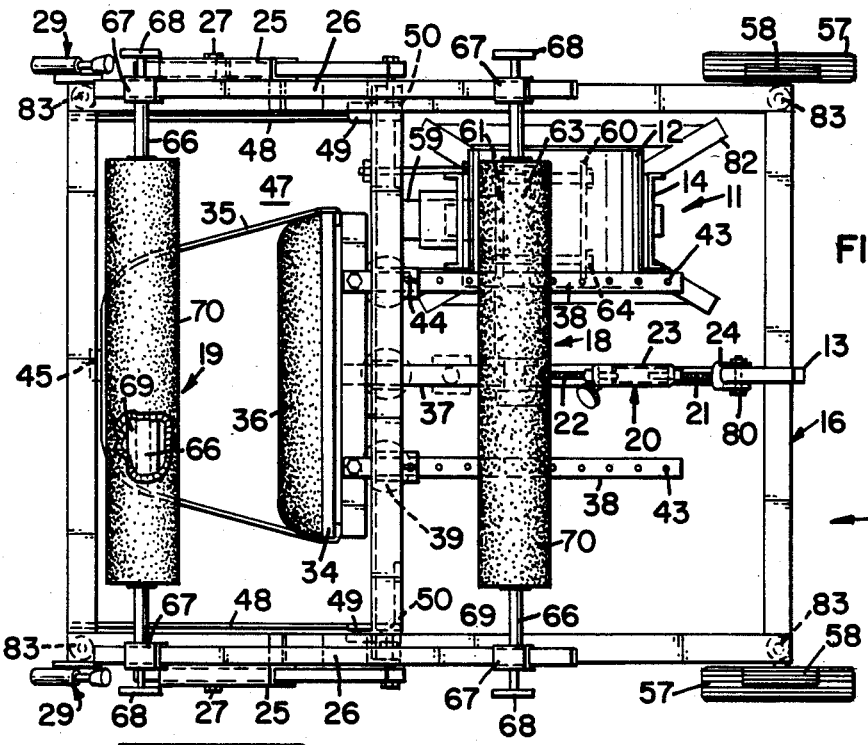
FIG. 3 is a top plan view of the embodiment of the invention shown in FIG. 1.

Still referring to FIG. 1, the dynamometer base 12 is effectively connected to the lower body restraint assembly 33 in the following fashion: the dynaometer base 12 is attached to the dynamometer support yoke 14 which is further attached to the dynamometer pedestal 15 as described above. A pedestal clamping member 59, preferably welded at one end to the support frame 16, extends from the lower horizontal member 62, as shown in FIG. 2. At the other end of the pedestal clamp member 59 there is fixedly attached an inside pedestal clamp 61 that includes two holes having female threads. The block 63, shown in FIG. 3, includes two holes having larger diameters than the holes in inside pedestal clamp 61. The block 63 is also notched to match or accommodate the shape of the dynamometer pedestal 15, as shown in FIG. 3. Pedestal clamping bolts 64 are inserted through the block 63 and are in threaded engagement with the inside pedestal clamp 61, thereby securely attaching the dynamometer pedestal 15 to the lower horizontal member 62 which is an integral part of the support frame 16. A pair of yoke bolts 65 attach the dynamometer yoke 14 to the support frame 16. The dynamometer pedestal 15 is further supported by a dynamometer platform 82 that engages the support frame 16. A rigid connection between the dynamometer base 12 in the support frame 16 is thereby effected, allowing a more accurate measurement of the torque created by the exercising individual on the dynamometer lever arm 13.

FIG. 2 shows a rear elevational view of the machine 10 as also shown in FIG. 1. The rear crosspiece assembly 18 can now be further described. It includes a crosspiece rod 66, preferably of steel construction, fixedly attached by any conventional technique to a sliding bracket 67 on each end. Also in engagement with the sliding bracket 67 is a friction knob 68 which, when loosened, allows the rear crosspiece assembly 18 to be slid along the interconnection link 26 so that the distance between the rear crosspiece assembly 18 and front crosspiece assembly 19 can be adjusted to fit the individual that is utilizing the isokentic machine.

FIG. 2 also clearly illustrates that the lever arm 13 is preferably centrally located in relation to the crosspiece assemblies 18 and 19. Thus it can be seen that the twisting moment on the lever arm 13 is eliminated by this mounting technique.

It can also be seen in FIG. 2 that the bumper brackets 32 are shaped so that the threaded bumpers 31 engage the swing arms 25 when the swing arms 25 reach their rear-most positions.

FIG. 3 shows that the forward stops 29 are aligned with swing arms 25 just as the swing arms 25 are aligned with the rearward stops 28 and 30. FIG. 3 also shows that the turnbuckle assembly 20 is substantially midway between the interconnection links 26.

FIG. 3 also shows the crosspiece assemblies 18 and 19. The crosspiece rods 66 are preferably welded to sliding brackets 67. The sliding brackets 67 are threadedly engaged with friction knobs 68 so that the crosspiece assemblies 18 and 19 can be adjusted and locked into place. The crosspiece rods 66 each support a crosspiece pipe 69, the crosspiece pipe 69 being concentric with and sliding upon the crosspiece rod 66. A cushion roller 70 is attached to each crosspiece pipe 69 to provide comfort for the exercising individual as he presses against the crosspiece assemblies 18 and 19 during the exercising process. Further connected to the crosspiece pipe 69 of the rear crosspiece assembly 18 is the front link rod 22 of the turnbuckle assembly 20. The crosspiece pipe 69 along with turnbuckle assembly 20 can therefore freely rotate about the crosspiece rod 66 as the upper body restraint assembly 17 is pivoted during operation of the machine. It should be noted that the front crosspiece assembly 19 is substantially identical to the rear crosspiece assembly 18 except that the front crosspiece assembly 19 is not attached to the turnbuckle assembly 20. It will be understood by those ordinarily skilled in the art of exercising machines that the lever arm 13 of the dynamometer 11 could be attached to the front crosspiece assembly 19 rather than the rear crosspiece assembly 18.

Figure 4:
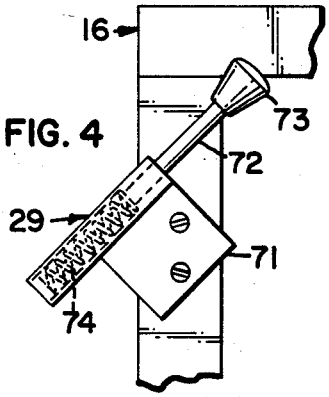
FIG. 4 is an enlarged view of a spring-loaded stop as shown in the embodiment shown in FIG. 1.

FIG. 4 shows an enlarged and cutaway version of one of the forward stops 29. As shown, the forward stop 29 includes a forward stop bracket 71 that is attached to the support frame 16 by any convenient means. The forward stop 29 further comprises a spring loaded foward bumper having a resilient forward bumper tip 73. A compression spring 74 is located within a recess formed by the forward stop bracket 71. The compression spring 74 urges the forward bumper 72 and forward bumper tip 73 toward and against the swing arm 25 so that a more gradual deceleration results when the swing arm 25 engages the forward stop 29. That is, the kinetic energy of the upper body restraint assembly 17 swing arms 25 is at least partially stored as elastic energy in the compression springs 74 upon engagement therewith. It should be noted that the compression springs 74 could be comprised of other types of springs, including gas springs.

Figure 5:
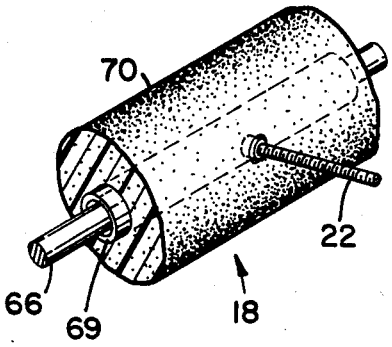
FIG. 5 is an enlarged and cross-sectional perspective view of a crosspiece and a link rod connected thereto taken from the embodiment shown in FIG. 1.

FIG. 5 shows a cutaway perspective view of the rear crosspiece assembly 18 showing the connection between the front link rod 22 and the crosspiece pipe 69 of the rear crosspiece assembly 18. Clearly, the front link rod 22 could be directly attached to the crosspiece rod 66, particularly if the crosspiece rod 66 were in a rotational relationship with the sliding bracket 67.

Figure 6:
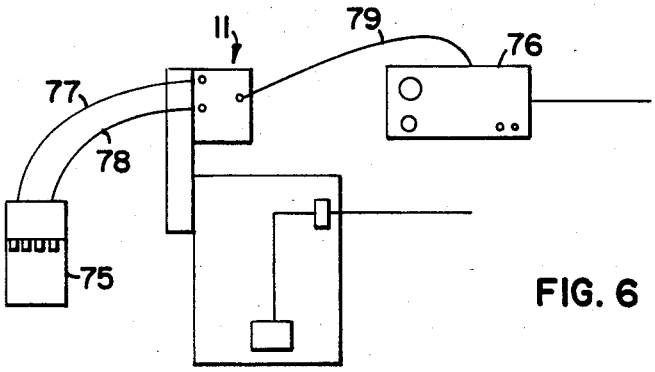
FIG. 6 is a somewhat schematic view of speed selector and read-out devices connected to an electromechanical dynaometer of a type suitable for use with the embodiment of the invention shown in FIG. 1.

FIG. 6 shows a schematic view of the dynamometer's accompanying instrumentation. The dynamometer 11 preferably has two electrical outputs: a torque output 77 and a position or angle output 78. The outputs 77 and 78 are preferably electrically connected to a display or a storage device. FIG. 6 shows the outputs 77 and 78 attached to a strip chart recorder 75. A maximum speed for the dynamometer is selected by the person running the test and communicated via speed input wire 79 to the dynamometer 11.

The operation of the isokinetic back exercise and monitoring device 10 can now be described. The strap latches 45 are unlatched and the front crosspiece assembly 19 is preferably removed from the interconnection links 26 so that the individual can easily step into the machine 10. The individual orients himself so that his lower back body surface engages the back board cushion 36. When he does so, his midsagittal plane, an imaginary plane passing through his spine perpendicular to his front and rear body surfaces, passes through and is perpendicular to the rear crosspiece assembly 18. Also, the individual's midsagittal plane intercepts the rear crosspiece assembly 18 at a point substantially midway between the interconnection links 26. When the individual is properly oriented, the electric motor 55 can be operated to cause the platform frame 48 and platform 47 to raise or lower so that the back board cushion 36 and front and rear crosspiece assemblies 19 and 18, respectively, engage the individual in comfortable and appropriate locations.

Once the vertical adjustment has been made, the lower body restraint can be effected by latching the strap latches 45. The upper body restraint can be effected by adjusting the front and rear crosspiece assemblies 18 and 19 respectively by loosening the sliding brackets 67 and sliding the crosspiece assemblies 18 and 19 along the interconnection links 26 as necessary to sandwich the individual between the crosspiece assemblies 18 and 19.

A horizontal adjustment may also be needed in the lower body restraint assembly 33. The hand knobs 39 can be loosened and cotter pins 44 removed so that the adjustment members 37 and 38 can be slid within the adjustment brackets 40 and 41. Once the horizontal adjustment has beem made, the hand knobs 39 are retightened and the cotter pins 44 are reinserted to secure the lower body restraint assembly 33 to the support frame 16.

A maximum speed is then set using speed selector 76 that is electrically coupled to the dynamometer 11. It should be noted that the invention may be used as an isometric exercise device. That is, the maximum speed may be set equal to zero so that the dynamometer 11 prevents any motion of the lever arm 13.

Once the speed is set, the individual may then extend and flex his back muscles, bending at the waist, thereby typically causing the upper body restraint assembly to pivot about bolts 27. The muscle contraction force generated by the exercising individual is opposed by the dynamometer 11 so that regardless of the force exerted by the individual, the velocity or angular rotation rate of the upper body restraint assembly 17 will not surpass the velocity set by the operator using the speed selector 76. The stops 28, 29 and 30 prevent the individual from damaging himself or the machine 10.

The distance between the rear crosspiece assembly 18 and the dynamometer lever arm 13 can be adjusted by using the turnbuckle assembly 20. When the turnbuckle 23 is rotated, the distance between the rear crosspiece assembly 18 and the lever arm 13 is changed. Also, the effective lengths of the swing arms 25 can be changed by removing the pivot bolts 27 and aligning new holes in the swing arms 25 with the bolt holes in the support frame 16 that accommodate the pivot bolts 27.

Since the dynamometer lever arm 13 is centrally located with respect to the rear crosspiece assembly 18, twisting moments on the lever arm 13 are not produced and therefore a more accurate measurement of the torque and power generated by the exercising individual is achievable.

Once the test is completed, the strap latches 45 and the front crosspiece assembly 19 may be removed so that the individual may easily disengage from the machine 10. The machine 10 can then be tipped on its back to engage the wheels 57 and 58 with the floor so that the machine 10 can be rolled about freely from one location to another.

Numerous characteristics and advantages of the invention have been set forth in the foregoing detailed description. It will be understood, of course, that this disclosure is in many respects, only illustrative. Changes may be made in details, particularly in matters of shape, size and arrangement of parts without exceeding the scope of the invention. For example, in one embodiment of the invention the lever arm 13 could be connected to the front crosspiece assembly 19 rather than the rear crosspiece assembly 18. Further, the lever arm 13 could be attached to the lower body restraint in an embodiment where the individual's upper body is constrained while his lower body is permitted, while resisted by the dynamometer 11, to move by contraction of his back muscles. The scope of the invention is defined in the language in which the appended claims are expressed, and is not limited to the embodiments described above.

I claim:

1. An isokinetic exercise and monitoring machine adapted to exercise and monitor an individual, the individual having a midsagittal plane, a front surface, a rear surface, a first body portion and a second body portion, and having a first axis located generally in a transverse plane between the body portions and about which the body portions can rotate with respect to one another, said machine comprising:

(a) first means for restraining the first body portion;

(b) second means for restraining the second body portion, said second restraining means being configured for movement with respect to said first restraining means about a second axis, said second axis being substantially parallel to the first axis and the midsagittal plane intersecting said second restraining means at a midpoint of said second restraining means when the individual is restrained by said first and second restraining means;

(c) a dynamometer having a first member and a second member, said second member being configured for movement with respect to said first member;

(d) first means for operatively connecting said first dynamometer member to said first restraining means; and (e) second means for operatively connecting said second dynamometer member to said second restraining means, said second connecting means being operatively connected to said second restraining means substantially at said midpoint, whereby movement of said second body portion about the first axis causes movement of said second restraining means about said second axis causing said second dynamometer member to move relative to said first dynamometer member.

2. The machine as recited in claim 1, wherein said first dynamometer member comprises a dynamometer base and said first connecting means comprises a support frame.

3. The machine as recited in claim 2, wherein said second dynamometer member comprises a lever arm configured for rotational movement with respect to said dynamometer base, said lever arm having a first end and a second end, said first end pivotally connected to said dynamometer base, and said second connecting means comprising means for length adjustment, said length adjustment means being pivotally connected to said second end of said lever arm and pivotally connected to said second restraint means, whereby said length adjustment means permits adjustment of a distance between said second end of said lever arm and said second restraint means.

4. The machine as recited in claim 3, wherein said length adjustment means comprises a first link rod having a first end and a second end, a turnbuckle, and a second link rod having a first end and a second end, said second ends of said link rods being in threaded engagement with said turnbuckle, said first end of said first link rod being pivotally connected to said second end of said lever arm, and said first end of said second link rod being pivotally connected to said second restraining means, whereby axial rotation of said turnbuckle in a first direction causes said length adjustment means to increase said distance between said second end of said lever arm and said second restraining means, and axial rotation of said turnbuckle in a second direction causes said length adjustment means to decrease said distance between said second end of said lever arm and said second restraining means.

5. The machine as recited in claim 4, wherein said second restraining means comprises means for pivoting said second restraining means about said second axis, wherein said pivoting means comprises a swing arm, means for operatively connecting said swing arm to said second restraining means, and means for pivotally connecting said swing arm to said support frame.

6. The machine as recited in claim 5, further comprising means for limiting the rotational movement of said swing arm.

7. The machine as recited in claim 6, wherein said movement limiting means comprises a stop, said stop connected to said support frame and configured to engage said swing arm at a predetermined point in the rotational movement of said swing arm.

8. The machine as recited in claim 7, wherein said stop comprises a spring, said spring being deformed upon engagment of said swing arm and said stop.

9. The machine as recited in claim 8, wherein said machine further comprises a plurality of wheels rotatably attached to said support frame, said wheels being adapted to support said machine, thereby making said machine rollable on a substantially planar and horizontal surface.

10. The machine as recited in claim 1, wherein said second restraining means comprises a first crosspiece assembly, a second crosspiece assembly, and a crosspiece assembly interconnection link, said crosspiece assemblies configured to sandwich the individual and having crosspiece assembly longitudinal axes substantially parallel to the first axis when the individual is sandwiched therebetween, said interconnection link connecting a first end of said first crosspiece assembly to a first end of said second crosspiece assembly, said axes being substantially perpendicular to said interconnection link, and said second connecting means being connected to said first crosspiece assembly.

11. The machine as recited in claim 10, wherein said first and second crosspiece assemblies are configured for rotation about said crosspiece assembly axes.

12. The machine as recited in claim 11, wherein each of said first and second crosspiece assemblies comprises a crosspiece rod having means for adjustment at a first end, said first ends of said crosspiece rods being proximate to said first ends of said crosspiece assemblies, said first ends of said crosspiece rods operatively connected to said interconnection link, and each of said first and second crosspiece assemblies comprising a crosspiece pipe, said crosspiece pipes being concentric to said crosspiece rods and configured to freely rotate thereupon, and each of said crosspiece pipes having a cushion roller attached to and substantially encircling an outside surface of said respective crosspiece pipe, wherein said adjustment means allows said crosspiece assemblies to be repositioned along a longitudunal axis of said interconnection link.

13. The machine as recited in claim 12, wherein said first connecting means comprises a support frame and said interconnection link is operatively coupled to said support frame by a means for pivoting said second restraining means about said second axis.

14. The machine as recited in claim 13, wherein said second connecting means is operatively connected to said first crosspiece pipe.

15. The machine as recited in claim 14, wherein said machine further comprises a plurality of wheels rotatably attached to said support frame, said wheels being adapted to support said machine, thereby making said machine rollable on a substantially planar and horizontal surface.

16. The machine as recited in claim 1, wherein the first body portion comprises the individual's inferior body with respect to the transverse plane, the second said portion comprises the individual's superior body with respect to the transverse plane, the individual's inferior body being oriented in a substantially upright orientation, said first restraining means adapted to restrain the individual's inferior body in a substantially vertical plane, said machine further comprising means for vertically moving the individual with respect to said first and second restraining means, and said vertical moving means being operatively connected to said first connecting means.

17. The machine as recited in claim 16, wherein said first connecting means comprises a support frame, and said vertical moving means comprises a substantially horizontal platform adapted to support the individual and means for vertically adjusting said platform.

18. The machine as recited in claim 17, wherein said platform vertical adjustment means comprises a vertically-oriented worm gear having a male worm thread and rotatably connected to said support frame, a driven block having a female worm thread in threaded engagement with said worm gear, said driven block being operatively connected to said platform.

19. The machine as recited in claim 18, wherein said worm gear is operatively connected to an output shaft of an electric motor, whereby rotation of said output shaft causes said worm gear to rotate.

20. The machine as recited in claim 19, wherein said first restraining means comprises an inferior rear restraint adapted to engage the individual's inferior rear surface, an inferior front restraint being adapted to engage the individual's inferior front surface, and means for attaching said inferior rear restraint to said inferior front restraint, whereby the individual's inferior body is sandwiched between said inferior rear restraint and said inferior front restraint.

21. The machine as recited in claim 20, wherein said inferior rear restraint comprises a substantially planar back board and said inferior front restraint comprises a strap attached at its ends to said back board.

22. The machine as recited in claim 21, further comprising means for horizontally adjusting said first restraining means in a direction parallel to the individual's midsagittal plane when the individual's inferior body is restrained by said first restraining means.

23. The machine as recited in claim 22, wherein said horizontal adjustment means comprises an adjustment member fixedly attached to said back board in perpendicular relation thereto, and a means for engaging said adjustment member, said engaging means being operatively connected to said support frame.

24. The machine as recited in claim 23, wherein said machine further comprises a plurality of wheels rotatably attached to said support frame, said wheels being adapted to support said machine, thereby making said machine rollable on a substantially planar and horizontal surface.

25. An isokinetic exercise and monitoring machine adapted to exercise and monitor an individual, the individual having a midsagittal plane, a front surface, a rear surface, a first body portion and a second body portion, and having a first axis located generally in a transverse plane between the body portions and about which the body portions can rotate with respect to one another, said machine comprising:

(a) first means for restraining the first body portion;

(b) second means for restraining the second body portion, said second restraining means being configured for movement with respect to said first restraining means about a second axis, said second axis being substantially parallel to the first axis and the midsagittal plane intersecting said second restraining means at a midpoint of said second restraining means when the individual is restrained by said first and second restraining means;

(c) first means for operatively connecting a first dynamometer member to said first restraining means; and (d) second means for operatively connecting a second dynamometer member to said second restraining means, said second connecting means being operatively connected to said second restraining means substantially at said midpoint, whereby movement of said second body portion about the first axis causes movement of said second restraining means about said second axis causing said second dynamometer member to move relative to said first dynamometer member when said dynamometer is operatively connected to said machine.

26. The machine as recited in claim 25, wherein said first dynamometer member comprises a dynamometer base and said first connecting means comprises a support frame.

27. The machine as recited in claim 26, wherein said second dynamometer member comprises a lever arm configured for rotational movement with respect to said dynamometer base, said lever arm having a first end and a second end, said first end pivotally connected to said dynamometer base, and said second connecting means comprising means for length adjustment, said length adjustment means being pivotally connected to said second end of said lever arm and pivotally connected to said second restraint means, whereby said length adjustment means permits adjustment of a distance between said second end of said lever arm and said second restraint means.

28. The machine as recited in claim 27, wherein said length adjustment means comprises a first link rod having a first end and a second end, a turnbuckle, and a second link rod having a first end and a second end, said second ends of said link rods being in threaded engagement with said turnbuckle, said first end of said first link rod being pivotally connected to said second end of said lever arm, and said first end of said second link rod being pivotally conencted to said second restraining means, whereby axial rotation of said turnbuckle in a first direction causes said length adjustment means to increase said distance between said second end of said lever arm and said second restraining means, and axial rotation of said turnbuckle in a second direction causes said length adjustment means to decrease said distance between said second end of said lever arm and said second restraining means.

29. The machine as recited in claim 28, wherein said second restraining means comprises means for pivoting said second restraining means about said second axis, wherein said pivoting means comprises a swing arm, means for operatively connecting sad swing arm to said second restraining means, and means for pivotally connecting said swing arm to said support frame.

30. The machine as recited in claim 29, further comprising means for limiting the rotational movement of said swing arm.

31. The machine as recited in claim 30, wherein said movement limiting means comprises a stop, said stop connected to said support frame and configured to engage said swing arm at a predetermined point in the rotational movement of said swing arm.

32. The machine as recited in claim 31, wherein said stop comprises a spring, said spring being deformed upon engagment of said swing arm and said stop.

33. The machine as recited in claim 32, wherein said machine further comprises a plurality of wheels rotatably attached to said support frame, wheels being adapted to support said machine, thereby making said machine rollable on a substantially planar and horizontal surface.

34. The machine as recited in claim 1, wherein the first body portion comprises the individual's inferior body with respect to the transverse plane, the second said portion comprises the individual's superior body with respect to the transverse plane, the individual's inferior body being oriented in a substantially upright orientation, said first restraining means adapted to restrain the individual's inferior body in a substantially vertical plane, said machine further comprising means for vertically moving the individual with respect to said first and second restraining means, and said vertical moving means being operatively connected to said first connecting means.

35. The machine as recited in claim 34, wherein said first connecting means comprises a support frame, and said vertical moving means comprises a substantially horizontal platform adapted to support the individual and means for vertically adjusting said platform.

36. The machine as recited in claim 35, wherein said platform vertical adjustment means comprises a vertically-oriented worm gear having a male worm thread and rotatably connected to said support frame, a driven block having a female worm thread in threaded engagement with said worm gear, said driven block being operatively connected to said platform.

37. The machine as recited in claim 36, wherein said worm gear is operatively connected to an output shaft of an electric motor, whereby rotation of said output shaft causes said worm gear to rotate.

38. The machine as recited in claim 37, wherein said first restraining means comprises an inferior rear restraint adapted to engage the individual's inferior rear surface, an inferior front restraint being adapted to engage the individual's inferior front surface, and means for attaching said inferior rear restraint to said inferior front restraint, whereby the individual's inferior body is sandwiched between said inferior rear restraint and said inferior front restraint.

39. The machine as recited in claim 38, wherein said inferior rear restrant comprises a substantially planar back board and said inferior front restraint comprises a strap attached at its ends to said back board.

40. The machine as recited in claim 39, further comprising means for horizontally adjusting said first restraining means in a direction parallel to the individual's midsagittal plane when the individual's inferior body is restrained by said first restraining means.

41. The machine as recited in claim 40, wherein said horizontal adjustment means comprises an adjustment member fixedly attached to said back board in perpendicular relation thereto, and a means for engaging said adjustment member, said engagement means being operatively connected to said support frame.

42. The machine as recited in claim 41, wherein said machine further comprises a plurality of wheels rotatably attached to said support frame, said wheels being adapted to support said machine, thereby making said machine rollable on a substantially planar and horizontal surface.

43. An isokinetic exercise and monitoring machine adapted to exercise and monitor an individual, the individual having a midsagittal plane, a lower body portion, an upper body portion and a coronal plane, the upper body being rotatable with respect to the lower body about a first axis located substantially in the coronal plane, said machine comprising:

(a) a support frame;
(b) first means for restraining the lower body portion, said first means operatively connected to said support frame;
(c) second means for restraining the upper body portion, said second means being pivotally connected to said support frame, allowing said second restraining means to pivot with respect to said support frame about a second axis, said second axis being substantially parallel to the first axis and the midsagittal plane intersecting said second restraining means at a midpoint of said second restraining means when the individual is restrained by said first and second restraining means;
(d) a dynamometer having a base and a lever arm, said lever arm being pivotally connected to said dynamometer base;
(e) first means for fixedly connecting said dynamometer base to said support frame; and
(f) second means for pivotally connecting said lever arm to said second restraining means, said second connecting means being operatively connected to said second restraining means substantially at said midpoint, whereby movement of the individual's upper body portion causes movement of said second restraining means about said second axis causing said lever arm to pivot on said dynamometer base.

44. The machine as recited in claim 43, wherein said second restraining means comprises a first crosspiece assembly having a longitudinal axis, a second crosspiece assembly having a longitudinal axis, and an interconnection link, said crosspiece assemblies operatively connected by said interconnection link and being adapted to sandwich the individual's upper body portion, said longitudinal axes being substantially parallel to the first and said second axes.

45. The machine as recited in claim 44, wherein said second restraining means comprises a swing arm, said swing arm being fixedly attached to said interconnection link and pivotally connected to said support frame.

46. The machine as recited in claim 45, said machine further comprising a spring-loaded stop fixedly attached to said support frame, said stop engaging said swing arm at a predetermined point in the rotation of said swing arm about said second axis.

47. The machine as recited in claim 46, said machine further comprising a plurality of wheels rotatably attached to said support frame, said wheels being adapted to support said machine, thereby making said machine rollable on a substantially planar and horizontal surface.

48. The machine as recited in claim 47, said machine further comprising a vertically adjustable platform operatively attached to said support frame, said platform being adapted to support the individual.

49. The machine as recited in claim 48, said machine further comprising an electric motor, said electric motor operatively connected to said platform, whereby said platform is vertically adjusted in response to rotational movement of an output shaft of said electric motor.

50. The machine as recited in claim 49, further comprising means for horizontally adjusting said first restraining means in a direction parallel to the individual's midsagittal plane when the individual's lower body portion is restrained by said first restraining means.

51. The machine as recited in claim 50, said horizontal adjustment means comprising an adjustment member fixedly attached to said first restraining means, and a means for releasably engaging said adjustment member, said engaging means being operatively connected to said support frame.

52. An isokinetic exercise and monitoring machine adapted to exercise and monitor an individual's back muscles, the individual having a midsagittal plane, a lower body and an upper body, and having a first axis located generally at the intersection of the individual's coronal plane and a transverse plane separating the upper and lower body portions and about which the body portions can rotate with respect to one another, said machine comprising:
(a) a support frame;
(b) means for restraining the individual's lower body adjustably connected to said support frame, said lower body restraining means being horizontally adjustable in a direction parallel to the individual's midsagittal plane when the individual's lower body is restrained by said lower body restraining means;
(c) means for restraining the individual's upper body comprising a swing arm, said swing arm being pivotally connected to said support frame, and said swing arm being pivotable about a second axis;
(d) a dynamometer having a base and a lever arm, said lever arm being pivotally connected to said base, said base being fixedly connected to said support frame and said lever arm being pivotally connected to said upper body restraining means;
(e) a spring-loaded stop fixedly attached to said support frame and positioned to engage said swing arm at a predetermined point in said swing arm's rotational movement about said second axis; and
(f) vertical adjustment means comprising a platform adapted to support the individual, said platform being operatively connected to a reversible electric motor, energization of said electric motor causing its output shaft to move in either a first or a second direction causing said platform to move either up or down, whereby movement of the individual's upper body about the first axis causes movement of said second restraining means about said second axis causing said lever arm to rotate about said dynamometer base.

* * * * *